US006995514B2

(12) United States Patent
Henning et al.

(10) Patent No.: US 6,995,514 B2
(45) Date of Patent: Feb. 7, 2006

(54) ELECTRODE SYSTEM FOR A METAL HALIDE LAMP, AND ASSOCIATED LAMP

(75) Inventors: Frank Henning, Berlin (DE); René Roatzsch, Berlin (DE)

(73) Assignee: Patent-Treuhand-Gesellschaft für elektrische Glühlampen mbH, Munich (DE)

( * ) Notice: Subject to any disclaimer, the term of this patent is extended or adjusted under 35 U.S.C. 154(b) by 438 days.

(21) Appl. No.: 10/460,265

(22) Filed: Jun. 13, 2003

(65) Prior Publication Data

US 2005/0280370 A1 Dec. 22, 2005

(30) Foreign Application Priority Data

Jun. 14, 2002 (DE) ..... 102 26 762
Jul. 4, 2002 (DE) ..... 202 10 400 U

(51) Int. Cl.
*H01J 61/06* (2006.01)

(52) U.S. Cl. ..... 313/631; 313/331; 313/574; 313/332

(58) Field of Classification Search ..... 313/631, 313/574–575, 638–641, 51, 49, 331–332, 313/335, 338, 625–626
See application file for complete search history.

(56) References Cited

U.S. PATENT DOCUMENTS

| | | | | |
|---|---|---|---|---|
| 5,451,837 | A | 9/1995 | Stevens et al. | |
| 6,342,764 | B1 | 1/2002 | Nishiura et al. | |
| 6,762,557 | B2 * | 7/2004 | Kanzaki et al. | 313/623 |
| 6,805,603 | B2 * | 10/2004 | Kawamura et al. | 445/46 |

FOREIGN PATENT DOCUMENTS

| | | |
|---|---|---|
| EP | 0 587 238 A1 | 3/1994 |
| EP | 0 587 238 B1 | 3/1994 |
| WO | 01/82331 | 11/2001 |

* cited by examiner

*Primary Examiner*—Karabi Guharay
(74) *Attorney, Agent, or Firm*—William E. Meyer

(57) ABSTRACT

The electrode system for a metal halide lamp with ceramic discharge vessel (4) comprises an electrically conductive leadthrough (9, 10) and an electrode connected thereto, the leadthrough having a fusible region with respect to the electrode, in which that end of the electrode which faces the leadthrough is embedded, at least the fusible region containing one of the high-melting metals Mo or W, and the electrode having a shank made from tungsten. In the regions surrounded by the material of the leadthrough, the electrode has a positively locking means which at least comprises a recess in the shank of the electrode.

13 Claims, 3 Drawing Sheets

ELECTRODE SYSTEM FOR A METAL HALIDE LAMP, AND ASSOCIATED LAMP

TECHNICAL FIELD

The invention is based on an electrode system for a metal halide lamp and an associated lamp in accordance with the preamble of claim 1. It deals in particular with lamps with an output of at least 20 W, preferably over 100 W, up to outputs of 400 W, if appropriate over 1000 W.

BACKGROUND ART

EP-A 587 238 has disclosed a metal halide lamp with a ceramic discharge vessel, in which a two-part leadthrough is sealed in an elongate stopper capillary by means of soldering glass at the end of the stopper which is remote from the discharge. The outer part of the leadthrough consists of permeable material (niobium pin), while the inner part consists of halide-resistant material (for example a pin made from tungsten or molybdenum). For relatively high lamp outputs (up to approximately 400 W), a different solution is used, namely that of replacing the inner Mo pin part by a cermet part. The coefficient of thermal expansion of this part can be adjusted as desired between that of other metal parts and that of the ceramic.

A drawback of solutions of this type is that the connection between the inner part of the leadthrough and the electrode is very prone to break. This is true both during further processing of the electrode system and during the service life of the system while the lamp is operating. Electrodes which bend can ultimately lead to the discharge vessel exploding during operation.

WO 01/82331 attempts to avoid this by using a multipart arrangement for the leadthrough. However, this represents only an inadequate solution to the basic problem. The diameter of the electrode is generally less than that of the inner part, the two components being connected by fusing the end of the inner part and embedding the end of the electrode in it. The fusing operation is often effected by brazing or laser soldering. The inner part usually consists of molybdenum or Mo-containing cermet. In this case, however, the amount of fusion at the inner part cannot be ensured reproducibly within the required level of accuracy. A remedy to this would be to increase the fusible length. However, this encounters problems with the limited maximum permissible "welding production height". What this means is an increase in height which results from a local accumulation of weld metal or solder in the region of the welding or soldering zone. It may also be slag (in particular in the case of a cermet connection). The maximum permissible degree of the increase in height is in this case determined by the minimum permissible capillary internal diameter of the discharge vessel.

DISCLOSURE OF THE INVENTION

It is an object of the present invention to provide an electrode system for a metal halide lamp, comprising an electrically conductive leadthrough and an electrode which is connected to the latter and has a shank, the leadthrough and the electrode having a connecting region with fused material in which that end of the shank of the electrode which faces the leadthrough is embedded, and the shank of the electrode being made from tungsten, in which system the connection between leadthrough and electrode is designed in such a way that it permanently withstands mechanical and thermal loads.

This object is achieved by the following features: the electrode, within the connecting region, has a positively locking means which comprises an at least local recess on the shank of the electrode.

Particularly advantageous configurations are to be found in the dependent claims.

According to the invention, a positively locking means, in particular a notch or groove, is arranged in the vicinity of that end of the electrode which faces the leadthrough. It is arranged sufficiently close to the end of the shank for it to be surrounded by the material of the leadthrough from the connecting region or fusible region. The means comprises at least one local recess or notch. An encircling recess which may be V-shaped, U-shaped, rectangular or trough-shaped is preferred. The notch may preferably be produced by grinding or stamping.

This notch may be an irregular or regular reduction in the cross section of the electrode. In particular, it is an encircling notch or groove in the shape of a U or V. When the leadthrough is being connected to the electrode, generally by soldering (brazing or soldering) or welding, the result is an additional positively locking connection which increases the ability of the connection to withstand mechanical loads. The rejection rate resulting from unacceptably large welding/soldering zone projections is also reduced, since there is now a reservoir available for the excess molten material or slag.

An additional advantage is that the recess offers a provisional option for fixing any filament which may be present at that end of an elongate electrode shank which is remote from the discharge; this filament is then definitively fixed particularly securely by fusion of the end region of the leadthrough, in a similar way to the fixing option which is known from U.S. Pat. No. 5,451,837.

The leadthrough may be produced in single-part form or may be constructed in two-part or multipart form by the outer part consisting of niobium or another hydrogen-permeable material while the inner part has properties which promote connection to the shank (cf. below). The inner part may be replaced by an elongated shank of the electrode, so that the joining technique according to the invention is applied to the connection between the outer leadthrough part, which is all that remains, and the correspondingly elongated core pin.

The known structure of ceramic discharge vessels also comprises a lengthened capillary tube (also referred to below as a stopper capillary), an electrically conductive, single-part or two-part leadthrough, which with respect to the discharge comprises an inner part and an outer pin-like part, being guided in a vacuum-tight manner through this stopper capillary. The lead-through is generally sealed on the outside of the stopper by soldering glass. The shank of an electrode which projects into the interior of the discharge vessel is secured to the inside of the leadthrough.

The output of the lamp is preferably between 20 and 400 W, but higher outputs (2000 W and above) are possible.

The appended table shows the dimensions for various lamp outputs (35, 70 and 150 W) for the following parts:

| | Core pin | | Groove | | | Leadthrough | | Fusible region |
|---|---|---|---|---|---|---|---|---|
| | | | Depth | Width | Distance | | | |
| Lamp Output | Material | ED [μm] | T [μm] | B [μm] | from end [μm] | Material | ED [μm] | Length [μm] |
| 35 | W | 200 | 30 | 50 | 50 | Mo or Nb | 560 | 150 |
| 70 | W | 300 | 50 | 100 | 50 | Mo or Nb | 680 | 225 |
| 70 | W | 300 | 60 | 70 | 70 | Mo or Nb | 680 | 225 |
| 150 | W | 500 | 70 | 100 | 70 | Cermet with Mo or Nb | 800 | 270 |
| 150 | W | 500 | 90 | 80 | 70 | Cermet with Mo or Nb | 800 | 250 |

Core pin: material and external diameter in μm;

Groove in the core pin: Depth T, width B and distance of the groove from that end of the pin which is remote from the discharge, in each case in μm;

Leadthrough; Material and external diameter in μm;

Fusible region: Length of the connecting region of the two components in μm.

The connection between the two components leadthrough and core pin is effected by laser soldering.

The ratio of the width B of the notch to its depth T is preferably in the region of B/T=1:1, and should in particular lie between 0.8 and 2.2. For stability reasons, the remaining external diameter of the core pin in the region of the notch should amount to at least 60% of the original diameter, preferably 65 to 75%.

In the case of a two-part leadthrough, the inner end region of the leadthrough (referred to below as the fusible region), which is in contact with the electrode, is made from Mo, W or a cermet which contains W in an amount which keeps it weldable. The diameter of the two parts which are to be connected may in this embodiment be approximately equal. The electrode preferably consists of tungsten. Its first end is embedded in the connecting region, while the second end faces the discharge. To limit the dead volume, the shank of the electrode may also be surrounded by a filament, preferably made from molybdenum, as is known per se.

Alternatively, there is also the option of replacing the inner part of the current leadthrough by means of an extended electrode core pin (generally made from tungsten) as far as the outer leadthrough part (generally made from niobium) in accordance with U.S. Pat. No. 6,342,764. To limit the dead volume, the shank of the electrode which has been lengthened in this way may likewise be surrounded by a filament, preferably made from molybdenum, as is also practiced with the two-part current supply (EP-A 587 238).

The leadthrough, or at least its outer part in the case of a two-part leadthrough, consists of an outer part, which is permeable to $H_2$ and $O_2$ and the thermal expansion of which is matched to the (aluminum oxide) ceramic (this part is in particular a pin or tube made from niobium, but it is also possible to use tantalum), which part is covered and sealed with soldering glass.

In the case of a two-part leadthrough, the inner part of the leadthrough consists of a halide-resistant metal (preferably molybdenum or tungsten or alloys thereof) or a corresponding cermet. The material is preferably molybdenum. The inner part is only partially covered with soldering glass and fused in at its outer end. The inner part is in particular a pin made from cermet or molybdenum or from tungsten, which has a higher melting point. The tungsten may have rhenium added to it, either as an alloy or as a plating on the surface. The rhenium increases the ability of the tungsten to withstand high temperatures and also its resistance to corrosion. While molybdenum is particularly suitable for mercury-containing fills, W is advantageously used for mercury-free fills. W is also particularly suitable for relatively low-wattage lamps from 70 W.

The inner part of the two-part leadthrough is connected on one side to the outer part (niobium pin or niobium tube) and on the other side to the electrode. The inner part itself may also be of multipart design, as described, for example, in WO 01/82331.

The stopper may be of single-part or multipart design. By way of example, a stopper capillary may be surrounded by an annular stopper part in a manner which is known per se.

BRIEF DESCRIPTION OF THE DRAWINGS

The text which follows is to explain the invention in more detail on the basis of a plurality of exemplary embodiments. In the drawing.

BEST MODE FOR CARRYING OUT THE INVENTION

Figure 1:
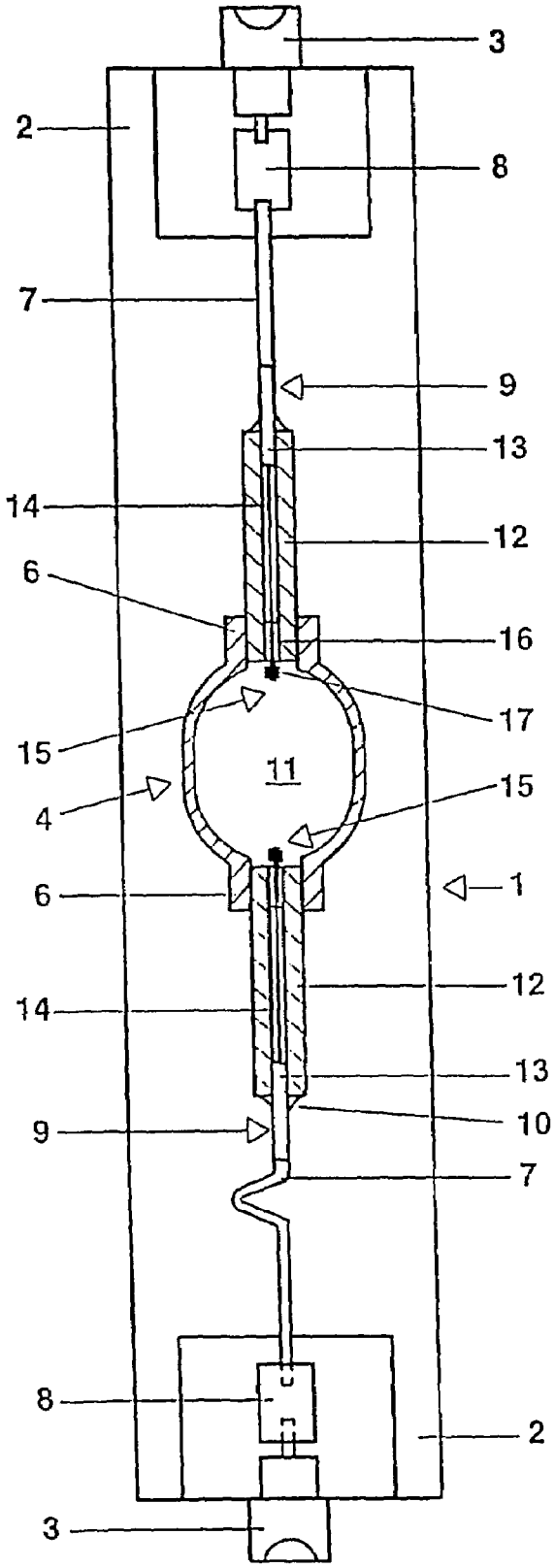
FIG. 1 diagrammatically depicts a metal halide lamp with a ceramic discharge vessel.

FIG. 1 diagrammatically depicts a metal halide lamp with an output of 150 W. It comprises a cylindrical outer bulb 1, which defines a lamp axis, is made from quartz glass and is pinched (2) and capped (3) on two sides. The axially disposed discharge vessel 4 made from $Al_2O_3$ ceramic is shaped in the form of a cylinder or with a bulge and has two ends 6. It is held in the outer bulb 1 by means of two supply conductors 7, which are connected to the cap parts 3 via foil 8. The supply conductors 7 are welded to leadthroughs 9, which are each fitted into an end stopper 12 at the end 6 of the discharge vessel. The stopper part is designed as an elongate capillary tube 12 (stopper capillary). The end 6 of the discharge vessel and the stopper capillary 12 are, for example, directly sintered to one another.

The leadthroughs 9 each comprise two parts. The outer part 13 is in each case designed as a niobium pin and projects into the capillary tube 12 over approximately a quarter of the length of the latter. The inner part 14 extends inside the capillary tube 12 toward the discharge volume. On the discharge side, it holds electrodes 15, comprising an electrode shank 16 made from tungsten and a filament 17 which is pushed onto the discharge-side end of the shank. The inner part 14 of the leadthrough is on one side laser-soldered to the electrode shank 15 and on the other side laser-welded to the outer part 13 of the leadthrough. The niobium pin 13 is inserted into the stopper capillary 12 to a depth of approximately 3 mm and is sealed by means of soldering glass 10.

In addition to an inert firing gas, e.g. argon, the fill of the discharge vessel comprises mercury and additions of metal halides. By way of example, it is also possible to use a metal halide fill without mercury, in which case the firing gas used may preferably be xenon and in particular a high pressure, well over 1.3 bar, can be selected.

Figure 2:
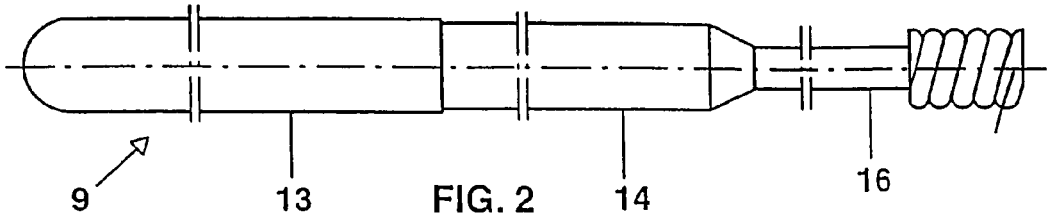
FIG. 2 diagrammatically depicts the electrode system of the lamp shown in FIG. 1 in detail.

FIG. 2 shows an electrode system in detail. The leadthrough 9 used is a system comprising a niobium pin (or tube) as outer part 13 and a molybdenum pin as inner part 14. On the discharge side, the niobium pin 13 is butt-welded to the inner part 14 made from molybdenum. On the discharge side, the inner part 14 is soldered to the electrode shank 16 in the same way.

The alternative is to use an inner part 14 made from cermet with a high Mo content, remainder $Al_2O_3$.

The shank 16 has a diameter of 0.4 mm. The diameter of the inner part is 0.8 mm, and that of the outer part is 0.88 mm. The inner part 14 therefore has a diameter which is 100% larger than that of the electrode shank 16.

Figure 3A:
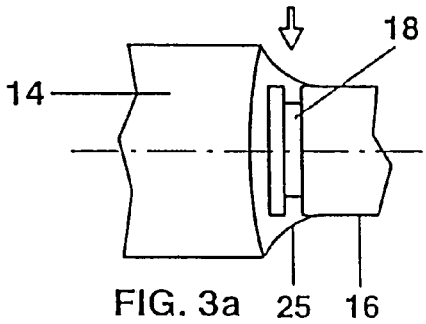
FIG. 3 diagrammatically depicts the connecting region of the electrode system shown in FIG. 2 with differently shaped notches (a to d)

FIG. 3*a* illustrates the principle of the connection according to the invention. Depending on the lamp power which is used, an encircling groove 18 is arranged at a distance of approximately 0.5 mm to 2 mm from the leadthrough-side end of the electrode shank 16. Once again depending on the output, it has a depth of from 0.5 to 2 mm and a width of from 0.5 to 2 mm. During the laser soldering (arrow), the fusible region 25 extends over the groove 18, which is in this case of rectangular configuration. The fused molybdenum is used as solder to embed the tungsten shank 16. The groove allows an additional positive lock to be produced and serves as a reservoir for excess molten material or the slag formed during segregation of cermet.

Figure 3B:
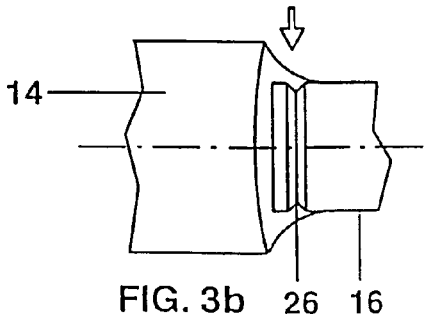
Figure 3C:
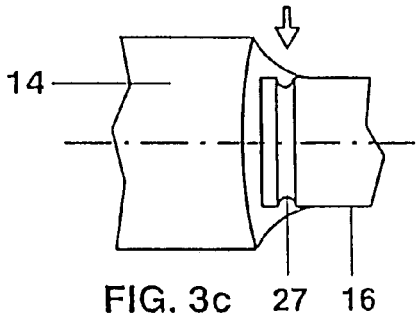
Figure 3D:
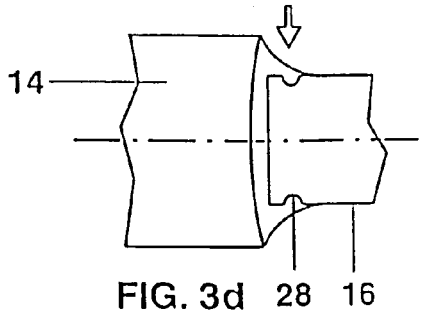

Alternatively, the groove may also have an encircling recess with a cross section shaped in some other way, in particular a V-shaped recess 26 (FIG. 3*b*) or a trough-like recess 27 (FIG. 3*c*). A further alternative is a positively locking means which comprises two notches 28 located on opposite sides in the shank (FIG. 3*d*).

Figure 4:
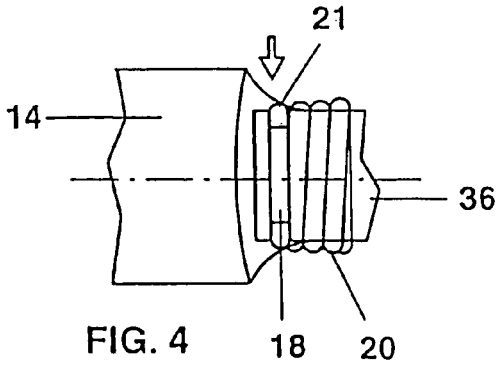
FIG. 4 diagrammatically depicts a further exemplary embodiment of the connecting region.

In a particularly preferred embodiment (FIG. 4), a filament 20 for displacement of the dead volume, consisting of molybdenum, is fitted to the shank 36, which is considerably elongated and therefore replaces the inner leadthrough part. The last turn 21 of the filament is held in the groove 18. As a result, during production, provisional fixing is achieved prior to the laser welding to produce the fusible region.

Figure 5:
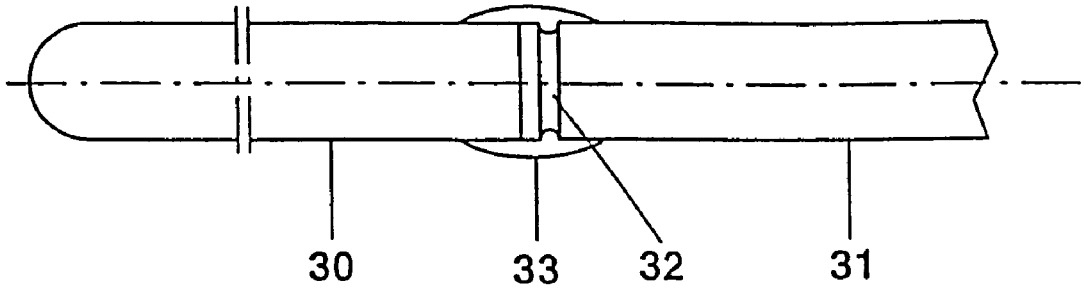
FIG. 5 diagrammatically depicts a further exemplary embodiment of the connecting region.

FIG. 5 shows an embodiment in which the leadthrough 30 (formed as a single part from niobium) has been brazed or welded to the elongated core pin 31 made from tungsten. The two components have approximately the same external diameter. The positively locking means is a notch 32. The connecting region 33, which may contain material from both components, is in this case illustrated highly diagrammatically.

Figure 6:
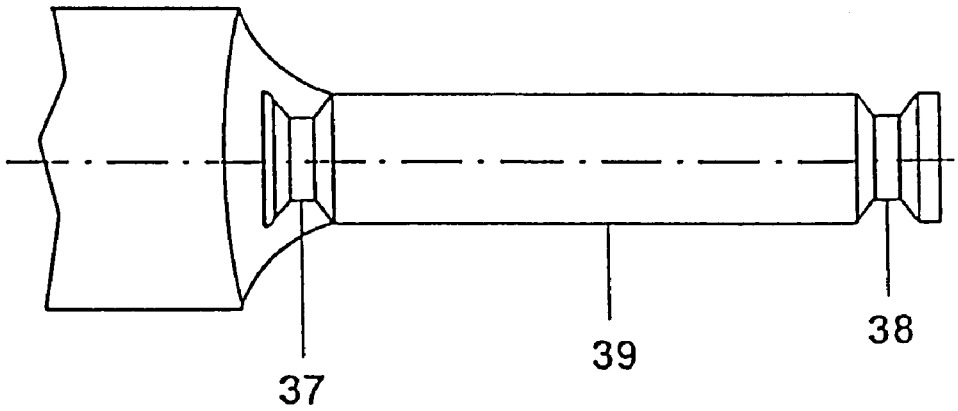
FIG. 6 diagrammatically depicts a further exemplary embodiment of an end region.

FIG. 6 shows a further embodiment, in which, in addition to the first groove 37 remote from the discharge, a second groove 38 in the vicinity of the front, discharge-side end of the shank 39 ensures that the second end of the filament can also be fixed. The filament is not shown. This configuration produces advantages in particular also on account of the simplification of the automatic positional orientation for the subsequent laser soldering. In this case, both notches 37 and 38 are shaped in the form of channels with inclined side walls.

What is claimed is:

1. An electrode system for a metal halide lamp, comprising an electrically conductive leadthrough and an electrode which is connected to the latter and has a shank, the leadthrough and the electrode having a connecting region with fused material in which that end of the shank of the electrode which faces the leadthrough is embedded, and the shank of the electrode being made from tungsten, wherein the electrode, within the connecting region, has a positively locking means which comprises an at least local recess on the shank of the electrode.

2. The electrode system as claimed in claim 1, wherein the leadthrough comprises an inner part and an outer part, the electrode being connected to the inner part.

3. The electrode system as claimed in claim 2, wherein the inner part consists of a weldable cermet.

4. The electrode system as claimed in claim 1, wherein the leadthrough and the electrode shank are cylindrical, the diameter of the leadthrough being 80 to 300% of the diameter of the electrode shank.

5. The electrode system as claimed in claim 1, wherein the positively locking means comprises two local recesses, on opposite sides from one another, or one encircling recess on the shank.

6. The electrode system as claimed in claim 5, wherein the recess is U-shaped or V-shaped, the base of the U or V defining a maximum indentation depth T.

7. The electrode system as claimed in claim 6, wherein the maximum indentation depth T amounts to 25 to 40% of the diameter of the shank.

8. The electrode system as claimed in claim 1, wherein the positively locking means is at a distance of 0.1 to 2 mm from that end of the shank which faces the leadthrough.

9. The electrode system as claimed in claim 1, wherein the electrode additionally comprises a filament at the end remote from the discharge, which filament surrounds the shank, that end of the filament which faces the leadthrough being anchored in the recess on the shank.

10. A discharge lamp having the electrode system as claimed in claim 1.

11. The discharge lamp as claimed in claim 10, wherein the lamp includes a ceramic discharge vessel, in particular made from $Al_2O_3$.

12. The discharge lamp as claimed in claim 11, wherein the discharge vessel has two ends, which are closed off by ceramic stoppers which each include an elongate capillary tube, referred to below as the stopper capillary, an electrically conductive leadthrough being guided through this stopper capillary, and an electrode with a shank (15) being secured to the leadthrough and projecting into the interior of the discharge vessel.

13. The discharge lamp as claimed in claim 10, wherein the lamp has a metal halide fill.

* * * * *